United States Patent [19]

Wessely

[11] 4,055,133

[45] Oct. 25, 1977

[54] METHOD AND APPARATUS FOR TRIPLE ROLL SEAMING END CLOSURES TO CONTAINER BODIES

[75] Inventor: Eugene Wessely, Colombes, France

[73] Assignee: Gallay S.A., Paris, France

[21] Appl. No.: 708,922

[22] Filed: July 26, 1976

[30] Foreign Application Priority Data

July 31, 1975 France ..... 75.23885

[51] Int. Cl.[2] ..... B21D 51/32

[52] U.S. Cl. ..... 113/120 Y; 113/1 E

[58] Field of Search ..... 113/120 Y, 30, 1 E, 113/16, 17, 19, 23 R; 220/67

[56] References Cited

U.S. PATENT DOCUMENTS

| | | | |
|---|---|---|---|
| 1,890,936 | 12/1932 | Douglass | 220/67 |
| 2,382,378 | 8/1945 | Bloedorn | 220/67 |
| 3,030,900 | 5/1962 | Munschauer | 113/30 |
| 3,367,533 | 2/1968 | Baker | 220/67 |
| 3,425,381 | 2/1969 | Wessely | 113/30 |
| 3,586,204 | 6/1971 | Roper | 220/67 |
| 3,736,893 | 6/1973 | Coppens et al. | 113/120 Y |
| 3,757,716 | 9/1973 | Gedde | 113/1 F |
| 3,987,927 | 10/1976 | Serr et al. | 220/67 |

FOREIGN PATENT DOCUMENTS

| | | | |
|---|---|---|---|
| 29,901 | 12/1919 | Norway | 113/19 |

*Primary Examiner*—Michael J. Keenan

*Attorney, Agent, or Firm*—Young & Thompson

[57] ABSTRACT

A method and apparatus for triple roll seaming flanged end closure to a flanged container body. Before the flanges of the end closure and container body are rolled together by a suitably shaped seaming roll, the peripheral portion of the end closure flange is imparted with a frustoconical portion at an angle between about 20° and 50° with respect to the yet undeformed part of the end closure flange followed by a first rolled section which curves substantially around, parallel to the frustoconical zone. The raising of the frustoconical portion and the forming of the first rolled section may be effected substantially simultaneously, either before or after the end closure is positioned in the open end of the container body, in a first tool setup including a single forming roll with parallel entry and exit zone joined through a frustoconical zone connected to a radiused zone. Alternatively the frustoconical zone may be stamped in the press when the flange of the end closure is formed in which case the rolled section is later formed at the free end of the frustoconical portion with a forming roll.

25 Claims, 14 Drawing Figures

METHOD AND APPARATUS FOR TRIPLE ROLL SEAMING END CLOSURES TO CONTAINER BODIES

FIELD OF THE INVENTION

The present invention relates to improvements in methods and apparatus for triple seaming end closures to the container body of sheet material containers, such as drums and barrels.

BACKGROUND OF THE INVENTION

My U.S. Pat. No. 3,425,381, assigned to the assignee of the present application, describes a method of securing an end closure to a container body by means of a triple rolled seam including seven layers of sheet metal (convention double seams comprise five layers of sheet metal). My earlier Patent described a method of forming such a triple rolled seam and apparatus for carrying out the method.

This technique provides a method of securing the radially outwardly extending flanges of the container body and of the end closures together in such a way as to maximize strength, to provide a perfect seal and to minimize amount of sheet material used.

In the method described in my above-mentioned U.S. patent a suitably shaped seaming roll drives back the radially outwardly extending flanges inward in a continuous manner to roll the peripheral portion of the end closure flange until the free outer edge thereof faces the yet undeformed container body end flange, near the outer periphery thereof. After this initial rolling phase, the two overlying flanges are rolled together in a continuous manner until the triple rolled seam is obtained. Such a triple rolled seam comprises a tight spiral made up of seven alternating layers of the end closure and container body sheet metal.

To minimize the amount of sheet material used, the peripheral portion of the end closure flange is rolled back on itself in the initial rolling phase which produces an initial rolled section which is the heart of the seam and must be as small as possible.

The seaming rolls used in this triple seaming method have a groove with a curved profile or contour having a number of different radii of curvature.

The prior art method achieves the sought after results when the thickness of the container body and end closure sheet material is less than one millimeter. Experience has shown, however, that with container body and end closure sheet material thicknesses greater than one millimeter it is difficult to form the initial rolled portion or section having a radius as small as possible when using seaming rolls designed for sheet metal thicknesses less than 1 millimeter.

The present invention is intended to overcome the difficulties associated with triple roll seaming sheet material thicknesses greater than 1 millimeter, while still being applicable to smaller sheet thicknesses.

SUMMARY OF THE INVENTION

According to the invention there is provided a method of triple roll seaming flanged sheet material end closures to a flanged sheet material container body, comprising, in any order, both introducing the end closure into an open end of the container body and deforming the end closure flange alone before rolling both flanges together radially inwardly around each other until a triple rolled seam is obtained including more than five layers of container body and end closure sheet material; wherein the improved step of deforming the end closure flange alone comprises: raising the peripheral portion of the flanged end closure into a frustoconical portion at a predetermined angle, and forming a first small radiused rolled section at the free end of the end closure flange.

The frustoconical portion may be formed with a forming roll or stamped, and the first rolled section by curling or rolling with the same or another forming roll.

The frustoconical portion of the end closure flange and the initial rolled section thereof are preferably formed in succession in a single tool setup with a single appropriately shaped forming roll, either before or after the end closure is positioned in the corresponding open end of the container body.

This method has two main advantages over the method defined in the above-referred U.S. patent:

a. The formation of the frustoconical portion of the end closure flange defines a circular zone on the container body flange which precisely determines the circle about which the peripheral portion of the end closure flange later continues to turn and the required relative positioning of the flanges;

b. the initial rolled section which forms the heart of the spiral seam is given, right from the outset, its final form which it retains, throughout rolling, inside the core of the rolled seam.

The container body and end closures may both be made of steel but the container body may alternatively be made of plastics material, such as polyethylene or polypropylene.

The angle between the frustoconical portion of the end closure flange and the general plane of the yet undeformed container body flange is between about 20° and about 50°, and more preferably between about 25° and about 40°. The angle of the frustoconical portion of the end closure is chosen in such a range to prevent the peripheral portion of the end closure flange from buckling during the rolling of the initial rolled portion.

The present invention further consists in an apparatus for triple roll seaming flanged sheet material end closures to a flanged sheet material container body, comprising means for holding the end closure for rotation about its axis; a first phase tool setup including displaceable forming tool means comprising means for raising a frustoconical portion in the peripheral region of the end closure flange at a predetermined angle relative to the yet undeformed rest of the end closure flange and means for forming a first small radiused rolled section at the free end of the flanged end closure; and a second phase seaming tool setup including radially displaceable seaming tool means for rolling the flanges together radially inwardly around each other until a triple rolled seam is obtained including more than five layers of end closure and container body sheet material.

The forming tool means preferably comprises a single forming roll though two different forming rolls may be used. The forming roll comprises a flat entry zone, a frustoconical zone angling up from the entry zone, a small radiused interconnecting zone connected to said frustoconical zone and to an exit zone which in turn is substantially parallel to said entry zone.

The radiused interconnecting zone preferably comprises a plurality of different radii of curvature and joins the inclined zone tangentially to the exit zone.

The angle between the frustoconical zone and the entry zone is between about 20° and about 50°, and more particularly between 25° and 40°.

For continuous operation, the use of such a single forming roll makes it possible to effect in a single pass the raising of the peripheral portion into a frustoconical portion and the first rolled section, the angle included between the frustoconical zone and the interconnecting radiused zone being selected as a function of the thickness of the sheet material of the end closure flange so as to use as little as possible but at the same time produce a perfect triple rolled seam.

The features and advantages of the invention will become more apparent in the course of the following description of preferred embodiments of the present invention, given by way of non limiting example, with reference to the accompanying drawings, in which:

DESCRIPTION OF THE PREFERRED EMBODIMENTS

Figure 1A:
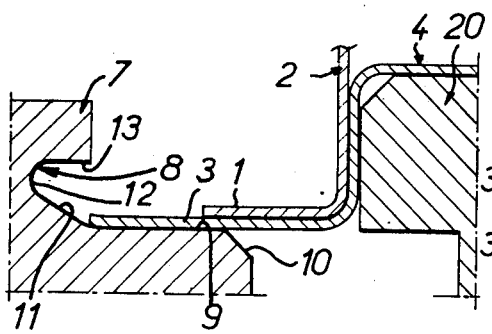
FIGS. 1*a*–1*d* diagrammatically illustrate a first phase seaming tool setup, the end closure being previously introduced into the corresponding open end of the container body, showing the steps of raising the frustoconical peripheral portion of the end closure flange and the forming of a first rolled section at the free end of the end closure flange.
Figure 2A:
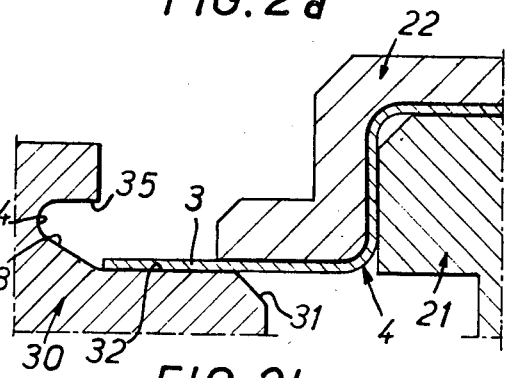
FIGS. 2*a*–2*d*, corresponding respectively to FIGS. 1*a*–1*d*, diagrammatically illustrate a first phase curling tool setup, the end closure being positioned alone between the chucks of the setup, and show the steps of raising the frustoconical peripheral portion of the end closure flange and the forming of a first rolled section at the free of the end closure flange.
Figure 1B:
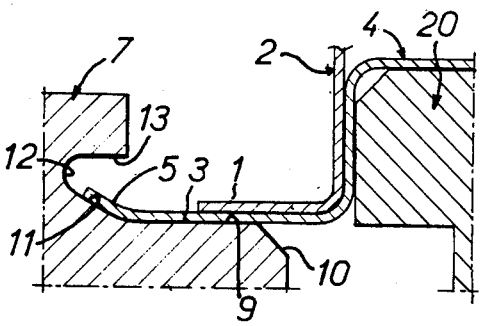
Figure 2B:
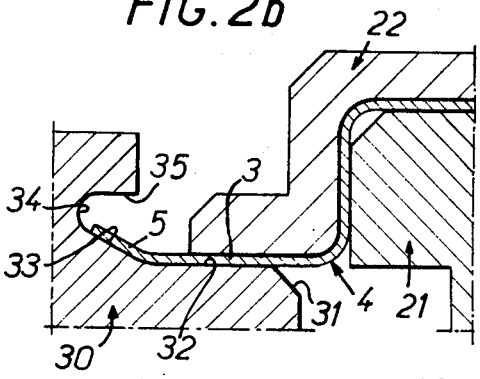

FIGS. 1*a* through 1*d* relate to the preferred method of the invention in which the first phase including raising the frustoconical portion 5 in the peripheral portion of the flanged end closure 4 and rolling the initial small radiused rolled section 6 is combined into a single operation made possible by the use of a single profiled tool or roll 7 having a small radiused annular groove 8 which, as viewed in cross section has four distinct zones, i.e. a flat entry zone 9 generally perpendicular to the axis of the container body 2 when in place with a chamber 10 at the radially outer end thereof, a frustoconical zone 11, joined to and continuing beyond the flat entry zone 9, a small radiused interconnecting zone 12 having plural radii of curvature and tangent with the frustoconical zone 11 and with a fourth zone, which is a flat exit zone 13 substantially parallel to the entry zone 9.

The initial position of the single first phase forming roll 7 is shown in FIG. 1*a* wherein the flange 3 of the end closure 4 overlies and extends radially outwardly beyond the container body flange 1, the end closure flange 3 being supported on the flat entry zone 9 of the annular groove of the initial roll forming roll or tool 7 to prevent buckling during the forming effected by this tool. The inclined frustoconical zone 11 progressively raises the peripheral portion of the end closure flange at a predetermined angle (between about 20° and 50°) before it reaches the small radiused zone 12 tangent to both frustoconical zone 11 and flat exit zone 13. The shape of the radiused zone 12 defines, as mentioned above, the heart of the resultant triple rolled seam. The flat exit zone 13 maintains the just rolled sheet, sets its height and keeps it in the radiused and inclined zones 12 and 11 of the annular groove 8.

Figure 1C:
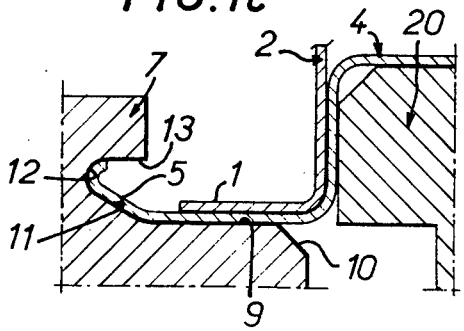
Figure 1D:
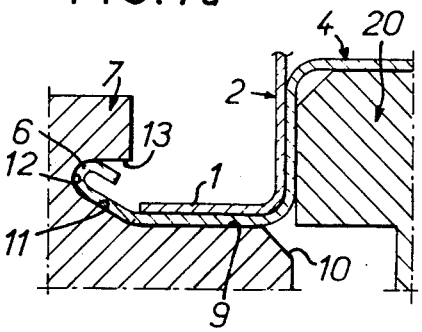

Thus, in operation, the assembly of the end closure 4 in the open end of the container body 2 is set into rotation on the chunk 20 as is known in the art and the first phase forming roll or tool 7 is progressively urged radially inwardly of the axis of the container body about which it rotates, through the steps of raising the peripheral portion 5 of the end closure 4 (FIG. 1*c*), and the initiation and continuation of the formation of the first rolled section 6 (FIGS. 1*c* and 1*d*). Accordingly with the single first phase roll or tool 7 both the raising of the frustoconical portion 5 and the formation of the first rolled section 6 are accomplished substantially simultaneously.

The first rolled section 6 at the periphery of the end closure 4 consists of a rolled section per se followed by a portion disposed substantially parallel to the frustoconical portion 5 and spaced therefrom a distance of approximately 1 to 2.5 times the thickness of the body sheet material, the length of this portion substantially parallel to the frustoconical portion being equal to or greater than approximately 1.5 times the thickness of the end closure flange sheet material.

Reference will now be made to FIGS. 2*a*–2*d* showing the sequence of operations of the first phase of the triple seaming method according to the invention when effected in a curling machine.

Once again the steps of raising the frustoconical portion and forming the first rolled section on the end closure flange are effected by a single forming tool or roll 30.

In this case the end closure 4 is gripped alone between a pair of complementary chuck members 21 and 22 of the curling machine so that the flange 3 of the end closure extends radially outwardly therefrom. The undersurface of the upper chuck member 22 mates with the upper surface of the end closure 4 and extends outwardly along the end closure flange 3. The upper chuck member 23 whereby cooperates with the lower chuck member 21 for clamping the central portion of the end closure 4 therebetween. Furthermore, it cooperates with the forming roll 30 to prevent the flange from lifting off the entry zone 32 during deformation. The outer periphery of the upper chuck member 22 substantially coincides with the circular zone referred to hereinafter, around which the frustoconical zone rotates in the initial stages of deformation in the second phase seaming tool setup of FIGS. 3 and 4. As with the above described embodiment the chuck members 21, 22 are mounted for rotation about an axis substantially corresponding to that of the end closure 4.

The curling tool or forming roll 30 of the curling machine is essentially the same as the forming roll 7 of the first phase seaming tool setup shown in FIGS. 1*a*–1*d* and described above and comprises an outer chamber 31 followed inwardly by a flat radial entry zone 32, a frustoconical zone 33, a radiused interconnecting zone 34 and a flat exit zone 35 substantially paralled to the entry zone 32.

The shape of the radiused zone 34 defines, as mentioned above, the heart of the resultant triple rolled seam. The flat exit zone 13 maintains the just rolled sheet, sets its height and keeps it in the radiused and inclined zones 33 and 34 of the annular groove.

Figure 2C:
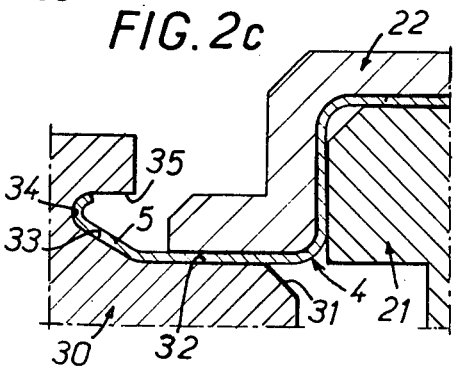
Figure 2D:
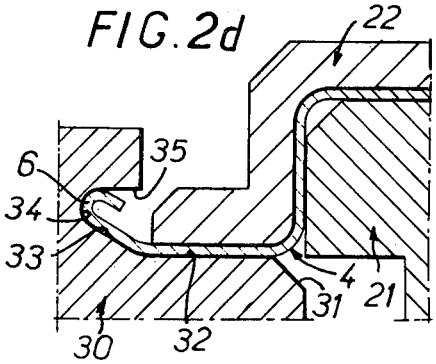

Thus, as in the previous embodiment, the end closure 4 clamped between chuck members 21 and 22 is set into rotation with the latter as is known in the art and the curling tool or forming roll 30 is progressively moved radially inwardly of the axis of the end closure 4, through the steps of raising the peripheral portion of the end closure 4 (FIG. 2*b*) and the initiation and completion of the formation of the first rolled section 6 (FIGS. 2*c* and 2*d*). Accordingly, in this embodiment too, the raising of the frustoconical portion 5 and the forming of the first rolled section 6 are accomplished by a single forming roll 30 substantially simultaneously. The end closure in FIG. 2*d* therefore is substantially identical to that of FIG. 1*d*.

Thereafter, the end closure may be subjected to some additional treatment, e.g. painting and/or a sealant may be applied in the peripheral portion, before the end closure 4 is introduced into the corresponding open end of the container body 2, the relationship of the flanges being substantially as shown in FIG. 1*d*.

It is even possible to form the frustoconical zone 5 in a press (not shown) at the same time the end closure 4 is sized and the flange 3 is formed. In this case the initial rolled section 6 could then be effected in the curling machine setup of FIGS. 2*c* and 2*d*.

It is obvious that the steps of stamping the frustoconical portion and rolling or curling the free end of the end closure may be effected in any order, in particular curling could precede or be effected simultaneously with the raising of the frustoconical portion.

The second phase of the seaming operation is effected with another seaming roll or tool 15 which is brought into position with respect to the flanges 3 and 1 of the end closure 4 and container body 2 where the first phase forming tool or roll 7 left off in FIG. 1*d* or after the end closure 4 of FIG. 2*d* is inserted into position in the open end of a container body 2, not otherwise shown.

Figure 3:
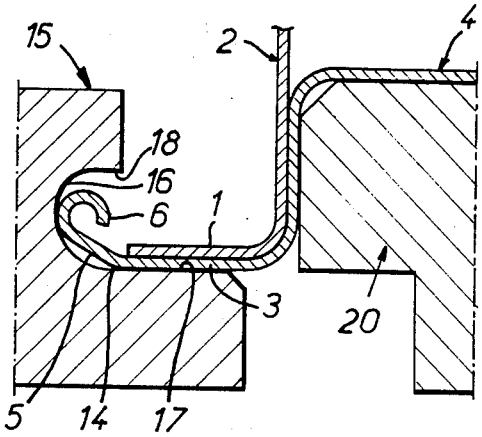
FIGS. 3 through 8 show consecutive stages in the completion of a triple rolled seam, essentially by rolling, in a second phase seaming tool setup including a second phase seaming roll, either after the FIG. 1*d* position is attained or the FIG. 2*d* position is attained in which case the end closure must first be positioned in the corresponding open end of the container body.
Figure 6:
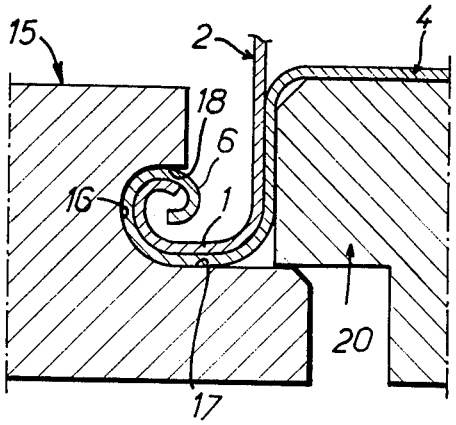

In the second phase starting position shown in FIG. 3 the circular zone 14 between the yet undeformed end closure flange and the frustoconical portion 5 defines the circle about which the end closure continues to roll as the second phase is initiated.

The second phase seaming roll 15 has a profiled annular groove which when viewed in cross section (FIGS. 3–8) comprises a flat entry zone 17 and a short flat exit zone 18 joined by a substantial radiused zone.

Figure 4:
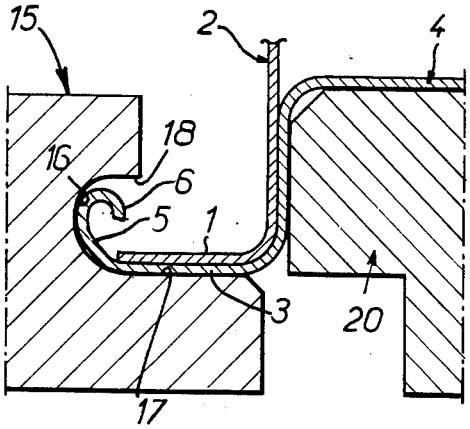
Figure 7:
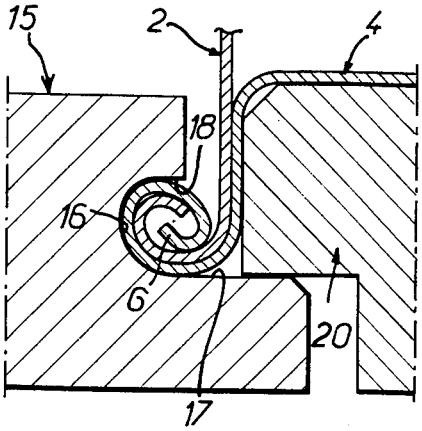

As the second phase seaming roll is moved radially inwardly from the FIG. 3 to the FIG. 4 position, the initial rolled portion of the end closure flange is raised and moved towards the annular groove. Up to this point (FIG. 4) there is no significant deformation of the body container flange 1 although it tends to enter the initial rolled section 6 by relative displacement.

Figure 5:
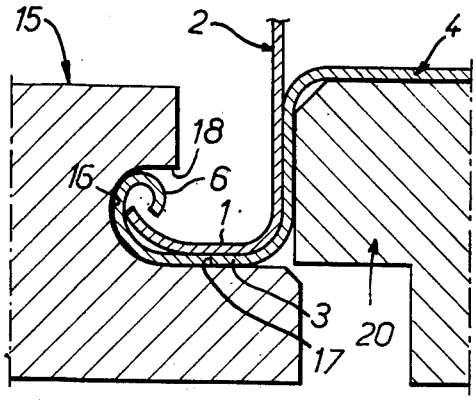
Figure 8:
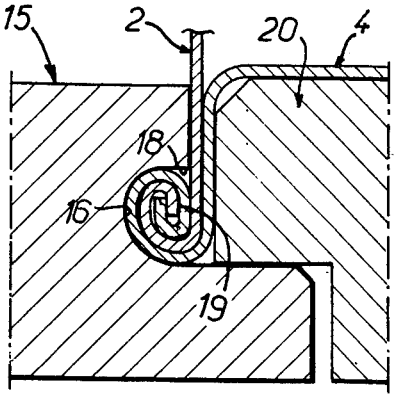

The end closure flange 3 then begins to take on the contour of the groove 16 upon continued radial inward displacement of the seaming roll 15 and the free end of the body container flange 1 curves up alone under the free edge of the rolled end closure flange as depicted in FIG. 5.

With continued radially inward displacement of the roller 15 the container body flange 1 mates with the inner surface of the rolled contour of the end closure flange 3. Finally the initial rolled section 6 of the end closure flange 3 reaches the outer surface of the container body 2 (FIG. 7) after which the flanges are rolled up tight against each other, the free end 19 of the container body flange "hooking" the first rolled section 6 thereby defining the heart of the spiral or triple rolled seam of seven layers of sheet material.

This sheet material is conventionally sheet steel, but the container body may be of plastic sheet of polyethylene or polypropylene.

A liquid polymerizable sealant may be injected along the flanges 1 and 3 at any time during the first phase of the rolling operation or even at the beginning of the second phase before the seam starts to close up.

Depending on the thickness of the sheet material, the inclination of the frustoconical zone 11 may vary between about 20° and about 50° and more preferably between about 25° and about 40°. The profile of the small radiused zone 12 of the first forming roll 7 is shaped so as to obtain the smallest possible first rolled section radius.

The invention is not limited to the embodiments and method described and illustrated herein but covers all alternatives and variations with the scope of the appended claims.

What I claim is:

1. A method for triple roll seaming flanged sheet material end closures to a flanged sheet material container body in which the end closure is received in an open end of the container body and the end closure flange is deformed alone before rolling the two flanges together; wherein the improved deformation step comprises raising a frustoconical portion at a predetermined angle in the peripheral portion of the flanged end closure and forming an initial, small radiused rolled section at the free end of said flanged end closure so that upon the completion of said improved deformation step the small radiused rolled section is disposed at the outer end of the completed frustoconical portion; and then rolling said flanges radially inwardly together around each other until a triple rolled seam is obtained including more than five layers of container body and end closure sheet material.

2. A method according to claim 1, further comprising introducing the end closure into the corresponding open end of the body container before the improved deformation step.

3. A method according to claim 1, further comprising introducing the end closure into the corresponding open end of the container body after the improved deformation step.

4. A method according to claim 1, wherein the forming step comprises rolling or curling the free end of the end closure flange.

5. A method according to claim 1, wherein the steps of raising said frustoconical portion and forming the initial, small radiused rolled section are carried out substantially simultaneously by continuous radially inward displacement of a first forming roll toward the axis of the end closure.

6. A method according to claim 5, wherein the step of rolling said flanges together is effected by the continuous radially inward displacement of a second phase seaming roll.

7. A method according to claim 1, wherein said peripheral portion is raised to an angle between about 20° and about 50° relative to the yet undeformed rest of the end closure flange.

8. A method according to claim 7, wherein the frustoconical portion is raised to angle between about 25° and about 40° relative to the yet undeformed rest of the end closure flange.

9. A method according to claim 1, wherein said end closure and body container sheet material is steel.

10. A method according to claim 1, wherein said end closure sheet material is steel and said body container sheet material is plastic.

11. A method according to claim 1, wherein the raising step comprises stamping the frustoconical portion in said end closure flange.

12. A method according to claim 4, wherein the stamping is effected before said end closure is received in the open end of said container body.

13. A method of triple roll seaming flanged sheet material end closures to a flanged sheet material container body, comprising, in any order, both introducing the end closure into an open end of the container body and deforming the end closure flange alone before rolling both flanges together radially inwardly around each other until a triple rolled seam is obtained including more than five layers of container body and end closure sheet material; wherein the improved step of deforming the end closure flange alone comprises: raising the peripheral portion of the flanged end closure into a frustoconical portion at a predetermined angle, and forming a first small radiused rolled section at the free end of the end closure flange so that upon the completion of said improved deformation step the small radiused rolled section is disposed at the outer end of the completed frustoconical portion.

14. A method according to claim 11, wherein the raising of the frustoconical portion in the end closure flange defines a circular zone near the juncture of the yet undeformed rest of the end closure flange with the frustoconical portion so as to set the flange of the end closure relative to the flange of the container body, further comprising continuing the rolling of end closure flange alone around the circular zone before the rolling both flanges together.

15. Apparatus for triple roll seaming flanged sheet material end closures to a flanged sheet material container body, comprising means for holding the end closure for rotation about its axis, a first phase tool setup including displaceable forming tool means comprising means for raising a frustoconical portion in the peripheral region of the end closure flange at a predetermined angle relative to the yet undeformed rest of the end closure flange and means for forming a first small radiused rolled section at the free end of the flanged end closure, said means for raising a frustoconical portion and said means for forming a first small radiused rolled section cooperating so that before a second phase seaming tool setup is brought into position the small radiused rolled section is disposed at the outer periphery of the frustoconical portion; and the second phase seaming tool setup including radially displaceable seaming tool means for rolling the flanges together radially inwardly around each other until a triple rolled seam is obtained including more than five layers of end closure and container body sheet material.

16. Apparatus according to claim 15, wherein said holding means holds end closure in an open end of said container body such that the end closure flange overlies and extends radially outwardly beyond the container body flange.

17. Apparatus according to claim 15, wherein said holding means holds the end closure for rotation about its axis comprises a pair of complementary chuck members between which the end closure is gripped alone.

18. Apparatus according to claim 15, wherein said forming tool means comprises a single forming roll, said means for raising a frustoconical portion comprises a flat, radial entry zone joined to a frustoconical zone and said means for forming the first small radiused section comprises a corresponding small radiused zone continued radially by a flat radial exit zone.

19. Apparatus according to claim 18, wherein said frustoconical zone in said forming roll is connected to said radiused zone, said flat radial entry and exit zones being substantially parallel to each other.

20. Apparatus for triple seaming according to claim 19 wherein said small radiused zone has a plurality of different radii of curvature and joins both said frustoconical zone and said flat radial exit zone tangentially.

21. Apparatus according to claim 19, wherein said frustoconical zone makes an angle of between about 20° and about 50° with the flat radial entry zone.

22. Apparatus according to claim 19, wherein said frustoconical zone makes an angle between about 25° and about 40° with said flat radial entry zone.

23. Apparatus according to claim 17, wherein said seaming tool means is a seaming roll and wherein the outer periphery of the upper of said pair of complementary chuck members defines in the radially inner most position of said forming tool the circular zone around which said frustoconical zone will rotate in response to radial inward displacement of said seaming roll.

24. A method of triple roll seaming flanged sheet material end closures to a flanged sheet material container body in which, before rolling both flanges together, the end closure is received in an open end of the container body and the end closure is deformed alone; wherein the improved deformation step comprises raising a frustoconical portion in the peripheral portion of the end closure flange to a predetermined angle with respect to the yet undeformed part of the end closure flange so as to form an inflection line therebetween, and forming an initial, small radiused rolled section at the free end of the frustoconical portion so that upon completion of the improved deformation step and after the end closure is received in the open end of the container body, the outer edge of the rolled section is directed toward the yet-undeformed container flange and the yet-undeformed container end flange overlies the yet-undeformed part of the end closure flange substantially up to the zone of inflection which defines a line of articulation for further deformation of the peripheral portion of the end closure flange, and then rolling the flanges radially inwardly together around each other until a triple rolled seam is obtained including more than five layers of container body and end closure sheet material.

25. A method according to claim 24, wherein, after the improved deformation step but before deformation of the container flange begins, the peripheral portion of the end closure flange is articulated about the line of articulation until the free outer edge of the end closure flange is brought into position facing the yet undeformed container flange proximate to the free outer edge thereof.

* * * * *